US006095834A

United States Patent [19]

Lai et al.

[11] Patent Number: 6,095,834

[45] Date of Patent: Aug. 1, 2000

[54] EJECTOR MECHANISM OF A CONNECTOR

[75] Inventors: Ming-Chun Lai, Shin-Juang; Shun-Chi Tung, Tu-Chen, both of Taiwan

[73] Assignee: Hon Hai Precision Ind., Co., Ltd., Taipei Hsien, Taiwan

[21] Appl. No.: 09/222,581

[22] Filed: Dec. 28, 1998

[30] Foreign Application Priority Data

Jul. 4, 1998 [TW] Taiwan ..... 87210764

[51] Int. Cl.[7] ..... H01R 13/62

[52] U.S. Cl. ..... 439/159

[58] Field of Search ..... 439/159

[56] References Cited

U.S. PATENT DOCUMENTS 5,967,811 10/1999 Yamamoto ..... 439/159

*Primary Examiner*—Lincoln Donovan
*Assistant Examiner*—Javaid Nasri
*Attorney, Agent, or Firm*—Wei Te Chung

[57] ABSTRACT

An ejector mechanism for a connector having a header, comprises a pivot extending from a surface of the header and having a head portion and a narrow portion extending downward from the head portion, wherein the head portion has a cross section greater than a cross section of the narrow portion. A lever defines a hole pivotably engaged with the pivot of the header and comprises a driving member and an engagement portion on opposite sides of the hole. An ejection plate is linked to and driven by the driving member of the lever, and defines a cutout for movably receiving the narrow portion of the pivot, wherein the ejection plate is retained at a constant vertical position by the head of the pivot. A push bar is engaged with the engagement portion of the lever and moves the ejection plate via the driving member of the lever upon receiving a push force.

15 Claims, 6 Drawing Sheets

EJECTOR MECHANISM OF A CONNECTOR

BACKGROUND OF THE INVENTION

1. Field of the Invention

The present invention relates to an ejector mechanism of a connector, and especially to an ejector mechanism for use in a PCMCIA connector which can prevent malfunction of a pivot portion of a lever thereof.

2. The Prior Art

PCMCIA card connectors have become popular in portable computers. The card connectors are commonly configured with an ejector mechanism having a lever for driving an ejecting plate to disconnect and eject IC cards therefrom.

A conventional ejector mechanism for a card connector 8, as shown in FIGS. 5 and 6, comprises a lever 82 defining a fulcrum opening 820 around which a rim 822 extends for pivotably engaging with a fulcrum protrusion 84 extending from a header 80. The lever 82 has a driving end 823 retained in a hole 85 of a closure 86 formed at an end of a push bar 81 which is slidably retained in an outer channel member 88 of the card connector 8. An ejection plate 83 is slidably mounted on the connector 8 and includes two ejection tabs 832 for ejecting a card (not shown) engaged with the header 80. Specifically, the ejection plate 83 has an L-shaped tab 831 extending downward therefrom for engaging with a reception portion 821 of the lever 82 and driven thereby when the lever 82 is driven by the push bar 81. The rim 822 has a height substantially equaling the height of the fulcrum protrusion 84. When the card is inserted into the header 80, a load exists due to the engagement therebetween. Therefore, when the lever 82 is driven by the push bar 81 to eject the card, the rim 822 of the lever 82 is apt to disengage from the fulcrum protrusion 84 resulting in a malfunction.

Therefore, it is requisite to provide a new ejector mechanism having an improved structure to retain the pivotable engagement between the lever and the fulcrum protrusion.

SUMMARY OF THE INVENTION

The primary purpose of the present invention is to provide an ejector mechanism for a card connector which guarantees reliable pivotable operation between a lever and a protrusion extending from a header thereof.

In accordance with one aspect of the present invention, an ejector mechanism for a connector having a header, comprises a pivot extending from a surface of the header and having a head portion and a narrow portion extending downward from the head portion, wherein the head portion has a cross section greater than a cross section of the narrow portion. A lever defines a hole pivotably engaged with the pivot of the header and comprises a driving member and an engagement portion on opposite sides of the hole. An ejection plate is linked to and driven by the driving member of the lever, and defines a cutout for movably receiving the narrow portion of the pivot, wherein the ejection plate is retained at a constant vertical position by the head of the pivot. A push bar is engaged with the engagement portion of the lever and moves the ejection plate via the driving member of the lever upon receiving a push force.

In accordance with another aspect of the present invention, an ejector mechanism for a connector having a header, comprises a pivot extending from a surface of the header. A recess is defined in the header substantially around the pivot. A lever defines a hole pivotably engaged with the pivot of the header, and comprises a rim extending downward from the lever substantially around the hole and rotatably received in the recess of the header, a driving member and an engagement portion on opposite sides of the hole. An ejection plate is linked to and driven by the driving member of the lever and defines a cutout for movably receiving the pivot. A push bar is engaged with the engagement portion of the lever and moves the ejection plate via the driving member of the lever upon receiving a push force.

These and additional objectives, features, and advantages of the present invention will become apparent after reading the following detailed description of the preferred embodiment taken in conjunction with the appended drawing figures.

DETAILED DESCRIPTION OF THE PREFERRED EMBODIMENT

Figure 1:
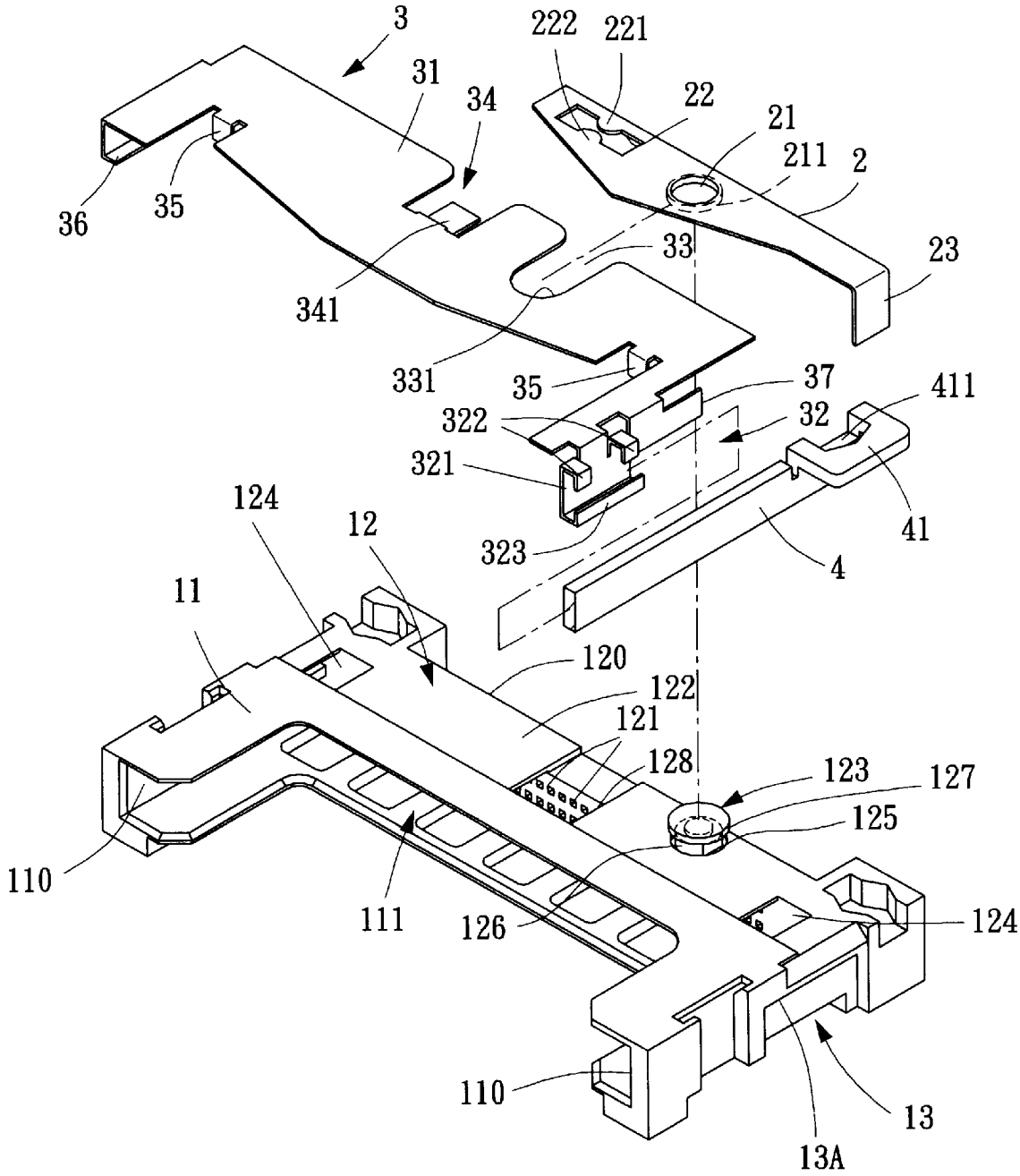
FIG. 1 is an exploded view of a card connector in accordance with the present invention.

Referring to FIG. 1, an ejector mechanism for a connector in accordance with the present invention comprises a lever 2, a pivot 123 extending from a header 120 of the connector for pivotably engaging with the lever 2, an ejection plate 3 movably driven by the lever 2 to eject an inserted card 100 (FIG. 4), and a push bar 4 slidably received in a side portion of the ejection plate 3 for driving one end of the lever 2 upon receiving a push force. The connector comprises a frame 12 and the ejector mechanism. The frame 12 includes the header 120 and a U-shaped guiding structure 11 connected to the header 120. The guiding structure 11 defines two inner channels 110 exposed toward each other for guiding the card 100 to contact the header 120. A reception space 111 is defined between the guiding structure 11 and a mating surface (not labeled) of the header 120 for receiving the card 100. The header 120 defines a plurality of holes 121 in the mating surface thereof for receiving contacts (not shown) therein. The header 120 comprises a cover 122 integrally formed on a top surface thereof.

The cover 122 defines a central hole 128 and two side holes 124 beside the central hole 128. Also referring to FIG. 2, the pivot 123 is an embossment projecting from the cover 122 between the central hole 128 and one of the side holes 124. The pivot 123 includes a head portion 127 and a narrower portion 126, wherein the head portion 127 has a larger diameter than that of the narrower portion 126. A circular groove 125 is defined in the cover 122 substantially around the embossment 123. Two concave portions 13 (only one shown) are defined in opposite outer sides of the guiding structure 11.

The lever 2 defines a hole 21 in a central portion thereof and a rim 211 projects downward from a periphery of the hole 21. An elongate hole 22 is defined near one end of the lever 2 and an engaging member 23 is formed at another end thereof. The elongate hole 22 defines a narrow portion in the center thereof between two semicircular portions 221, 222 extending from opposite peripheries thereof.

The ejection plate 3 is a U-shaped metal plate having a middle plate 31 with two engaging arms 36, 37 extending from opposite ends thereof. The middle plate 31 defines a first cutout 34 and a second cutout 33 from a rear edge into a middle portion thereof. Two ejection tabs 35 extend downward from a front edge thereof. The second cutout 33 forms a semicircular wall 331 for mating with the narrow portion 126 of the embossment 123 when the ejection plate 3 is mounted on the frame 12. An L-shaped plate 341 extends downward from an inner periphery of the first cutout 34. A receptacle 321 is formed on the engaging arm 37 and comprises two upper hooks 322 and a lower hook 323 extending toward the upper hooks 322.

The push bar 4 forms a retention member 41 at one end thereof which is a U-shaped structure defining a retention hole 411 therein.

Figure 2:
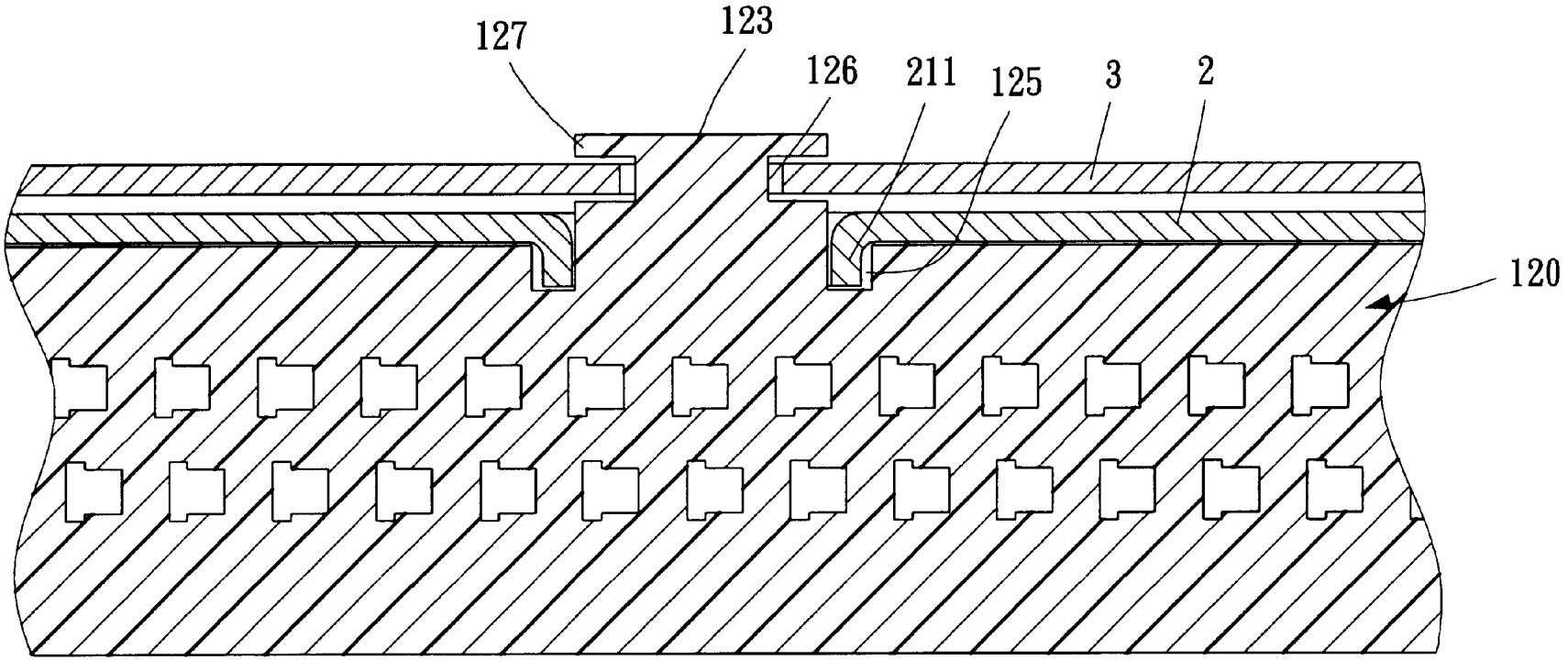
FIG. 2 is a cross sectional view showing engagement between a lever and a header of the connector of FIG. 1.
Figure 3:
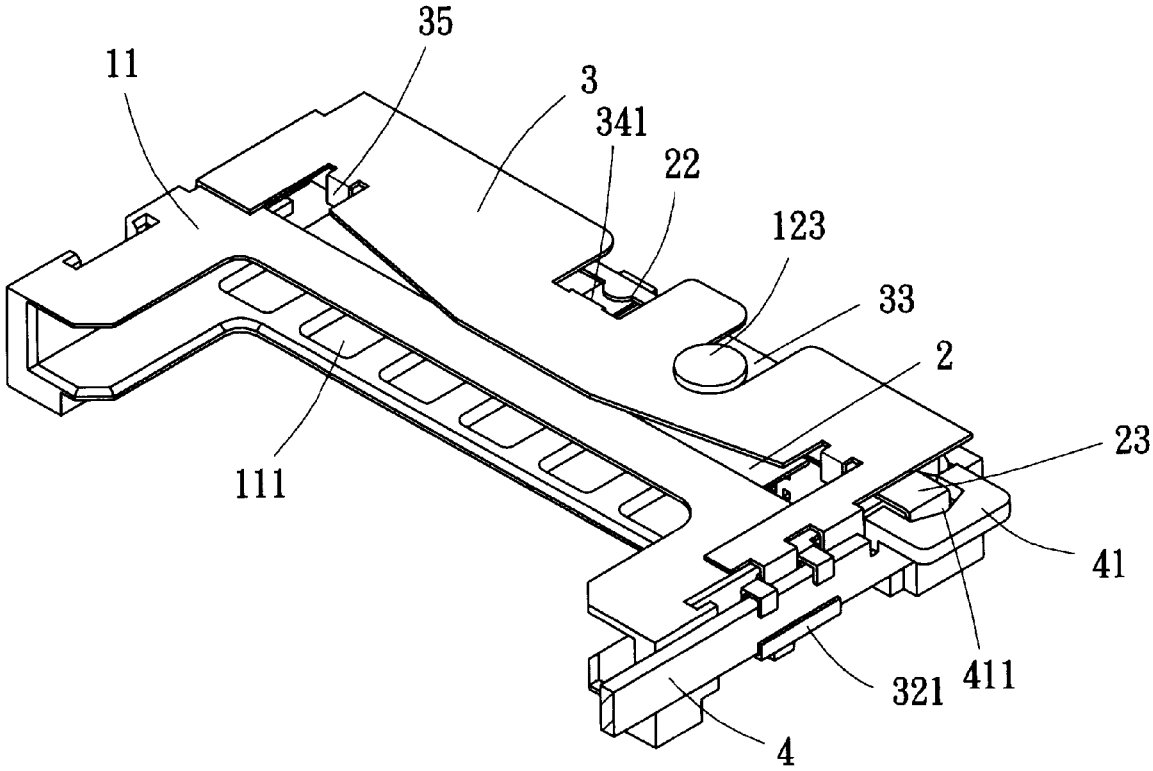
FIG. 3 is an assembled view of FIG. 1.
Figure 4:
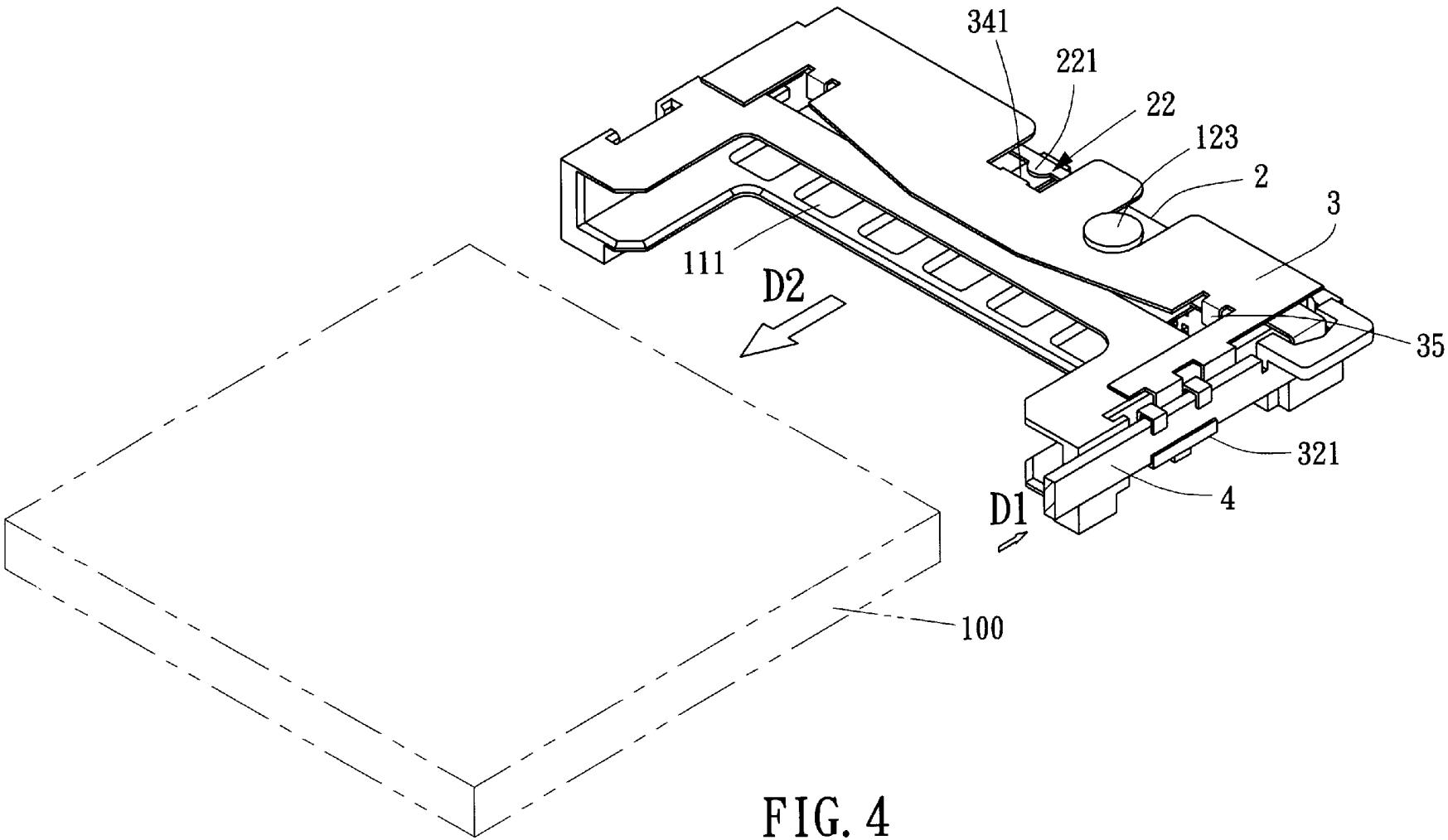
FIG. 4 is view similar to FIG. 3 showing a card being ejected from the connector.
Figure 5:
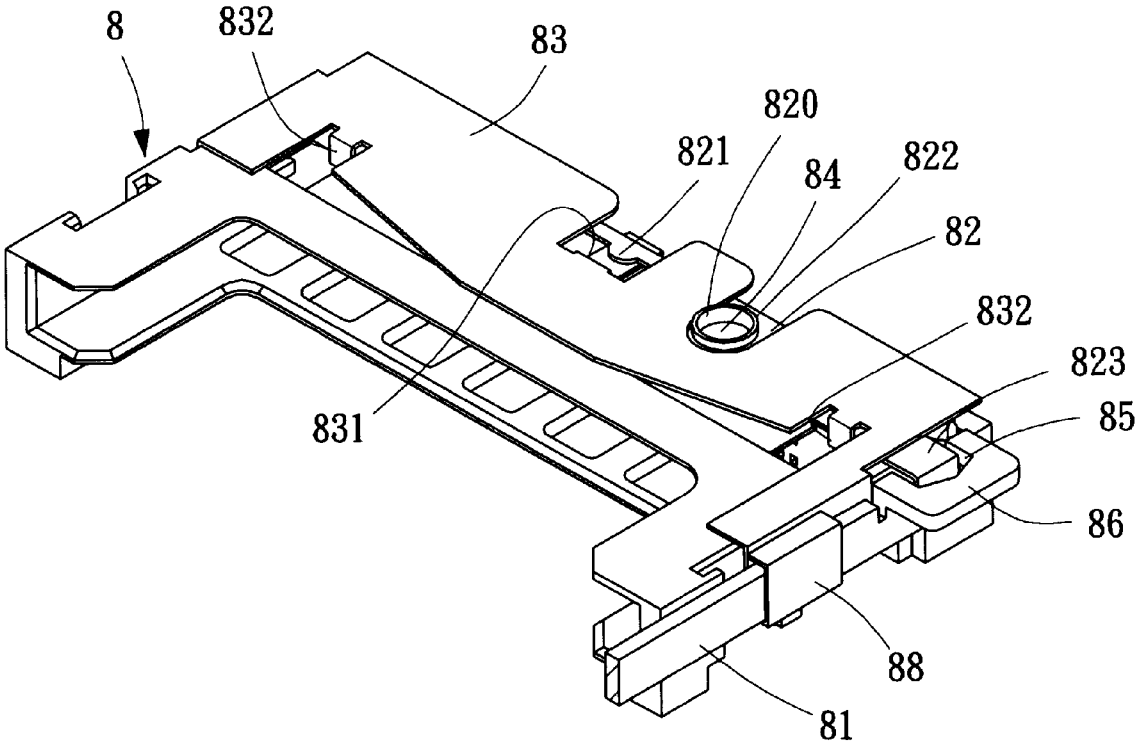
FIG. 5 PRIOR ART
FIG. 5 is perspective view of a conventional card connector wherein the lever is operated to almost disconnect from a fulcrum protrusion.
Figure 6:
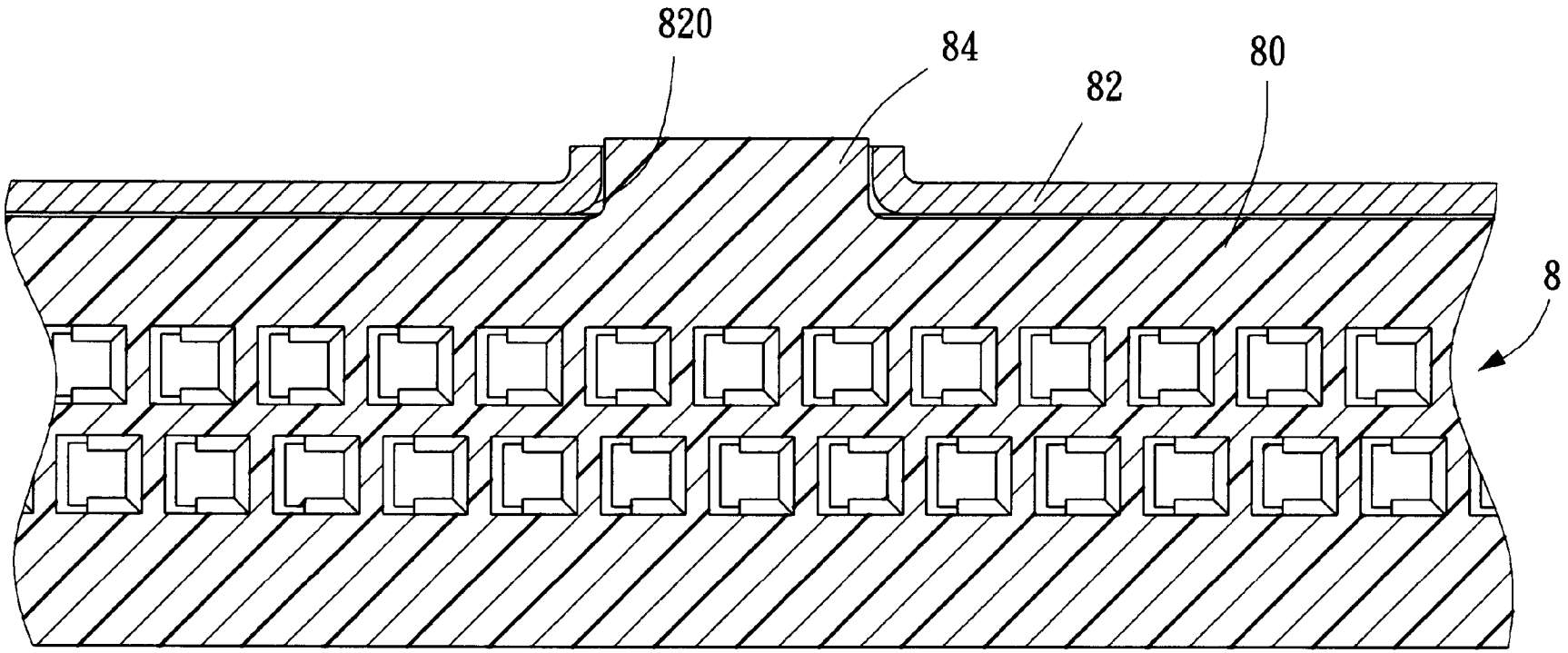
FIG. 6 PRIOR ART
FIG. 6 is a schematic view of FIG. 5 showing a relationship between a lever and a fulcrum protrusion of a header of the conventional card connector.

Also referring to FIGS. 2, 3 and 4, the lever 2 is pivotably engaged with the cover 122 by extending the embossment 123 of the cover 122 into the hole 21 of the lever 2, whereby the rim 211 of the lever 2 is pivotably retained in the circular groove 125 of the cover 122. The lever 2 will be retained at a vertical level during rotation because the rotational orientation of the rim 211 is downward rather than upward. The ejection plate 3 is movably connected to the lever 2 by extension of the L-shaped plate 341 thereof into the elongate hole 22 of the lever 2. The L-shaped plate 341 moves within the central hole 128 of the cover 122 when driven by either of the semicircular portions 221, 222 in opposite directions.

The second cutout 33 of the ejection plate 3 has a width greater than the diameter of the narrow portion 126 of the embossment 123 and less than the diameter of the head portion 27 thereof. Therefore, the ejection plate 3 can move on the over 122 without being blocked by the embossment 123. The ejection tabs 35 are movably located within the side holes 124 of the cover 122 so as to eject the card 100 when the ejection plate 3 is driven by the lever 2 to move in a direction opposite to the insertion direction of the card 100.

The ejection plate 3 is slidable on the frame 12 with flange portions of the engaging arms 36, 37 being slidably engaged with an upper side wall 13A of the concave portions 13 of the guiding structure 11.

Particularly referring to FIG. 3, the push bar 4 is slidably received in the receptacle 321, with a portion thereof being loosely enclosed by the upper hooks 322 and the lower hook 323. The engaging member 23 of the lever 2 is retained in the retention hole 411 of the push bar 4.

In operation, particularly referring to FIG. 4, the push bar 4 is manually operated to slide forward along a first direction D1 in the receptacle 321 causing the lever 2 to rotate about the embossment 123 thereby moving the ejection plate 3 to eject the inserted card 100 by the ejection tabs 35 along a second direction D2 opposite the first direction D1. With this structure, the pivotable movement of the lever 2 with respect to the header 120 can be retained at a constant vertical level thereby preventing improper operation of the lever 2.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. An ejector mechanism for a card connector having a header, comprising:

a pivot extending from a surface of the header, said pivot including a circular head portion and circular narrow portion; the narrow portion extending downward from the head portion, wherein the head portion has a cross section greater than a cross section of the narrow portion;

a lever defining a hole pivotably engaged with the pivot of the header and comprising a driving member and an engagement portion on opposite sides of the hole;

an ejection plate linked to and driven by the driving member of the lever, and defining a cutout for movably receiving the narrow portion of the pivot, wherein the cutout is so dimensioned that the ejection plate is retained in a vertical direction by the head portion of the pivot; said lever being positioned between said ejection plate and said header; and a push bar engaged with the engagement portion of the lever for moving the ejection plate via the driving member of the lever upon receiving a push force.

2. The ejector mechanism as claimed in claim 1, wherein the driving member of the lever is an elongate hole having two curved contacting portions and a narrow portion defined between the two curved contacting portions.

3. The ejector mechanism as claimed in claim 2, wherein the ejection plate has a follower portion perpendicularly extending from one edge thereof for retention in the elongate hole of the lever and driven by either of the curved contacting portions to move in opposite directions at different times.

4. The ejector mechanism as claimed in claim 1, wherein the ejection plate has channel means including a lower L-shaped plate and an upper L-shaped plate extending from a side wall of the ejection plate for slidably receiving the push bar therein.

5. The ejector mechanism as claimed in claim 3, wherein the ejection plate comprises at least one ejection tab extending downward from an edge thereof opposite the edge from which the follower portion extends.

6. The ejector mechanism as claimed in claim 1, wherein the push bar has a retention member formed at one end thereof for engaging with the engagement portion of the lever.

7. An ejector mechanism for a connector having a header, comprising:

a pivot extending from a surface of the header, said pivot including a circular head portion and circular narrow portion;

a groove defined in the surface of the header substantially around the pivot;

a lever defining a hole pivotably engaged with the pivot of the header, and comprising a rim extending downward from the lever substantially around the hole and pivotably received in the groove, of the header, a driving member and an engagement portion on opposite sides of the hole;

an ejection plate linked to and driven by the driving member of the lever and defining a cutout for movably receiving the pivot, said lever being positioned between said ejection plate and said header; and a push bar engaged with the engagement portion of the lever and moving the ejection plate via the driving member of the lever upon receiving a push force.

8. The ejector mechanism as claimed in claim 7, wherein said narrow portion extending downward from the head portion, the head portion having a cross section greater than a cross section of the narrow portion and the cutout of the ejection plate having a width greater than a diameter of the narrow portion of the pivot and less than a diameter of the head of the pivot.

9. The ejector mechanism as claimed in claim 8, wherein the driving member of the lever is an elongate hole having two curved contacting portions and a narrow portion defined between the two curved contacting portions.

10. The ejector mechanism as claimed in claim 9, wherein the ejection plate has a follower portion perpendicularly extending from one edge thereof for retention in the elongate hole of the lever and driven by either of the curved contacting portions to move in opposite directions at different times.

11. The ejector mechanism as claimed in claim 7, wherein the ejection plate has channel means including a lower L-shaped plate and an upper L-shaped plate extending from a side wall of the ejection plate for slidably receiving the push bar therein.

12. The ejector mechanism as claimed in claim 10, wherein the ejection plate comprises at least one ejection tab extending downward from an edge thereof opposite the edge from which the follower portion extends.

13. The ejector mechanism as claimed in claim 7, wherein the push bar has a closure member formed at one end thereof for engaging with the engagement portion of the lever.

14. A header for use within a connector having an ejector mechanism including a lever and an ejection plate thereof, comprising:

a plurality of holes for receiving contacts therein, respectively;

a cover integrally formed on a top surface of the header;

a pivot vertically upward extending from the top surface for fitting within a hole defined in the lever and including a head portion and a narrow portion for retaining the ejection plate at a vertical position; and a circular groove defined in the cover around the pivot for retaining the lever by means of fitting a rim extending downward from a periphery of the hole of the lever into the groove.

15. The header as claimed in claim 14, wherein said cover further includes a central hole and two side holes beside the central hole.

* * * * *